US006601304B2

(12) United States Patent
Yeh

(10) Patent No.: US 6,601,304 B2
(45) Date of Patent: Aug. 5, 2003

(54) HAIRDRESSING SCISSORS HAVING A DETACHABLE CONNECTING BLOCK

(76) Inventor: Wen-Ya Yeh, Suite 2, 15th Floor, No. 18, Chuney-Hsueh Road, Tainan (TW)

( * ) Notice: Subject to any disclaimer, the term of this patent is extended or adjusted under 35 U.S.C. 154(b) by 119 days.

(21) Appl. No.: 10/000,059

(22) Filed: Nov. 1, 2001

(65) Prior Publication Data

US 2003/0079352 A1 May 1, 2003

(51) Int. Cl.[7] ..... B26B 13/00
(52) U.S. Cl. ..... 30/226; 30/254
(58) Field of Search ..... 30/226

(56) References Cited

U.S. PATENT DOCUMENTS

| | | | | |
|---|---|---|---|---|
| 184,914 A | | 11/1876 | Scripps | 30/226 |
| 464,075 A | * | 12/1891 | Krank | 7/163 |
| 550,483 A | | 11/1895 | Carrier | |
| 1,012,918 A | | 12/1911 | Roelants et al. | 30/226 |
| 1,715,898 A | | 6/1929 | Carri | |
| 2,272,580 A | | 2/1942 | Phillips | |
| 2,456,858 A | | 12/1948 | Bolling | |
| 2,840,905 A | * | 7/1958 | Geiger | 30/226 |
| 3,831,277 A | * | 8/1974 | Nagata | 30/195 |
| D267,996 S | | 2/1983 | Kowalski | 30/226 |
| 5,600,891 A | | 2/1997 | Orgal | 30/226 |
| 5,875,553 A | | 3/1999 | Geib, Jr. et al. | 30/226 |
| 5,996,592 A | | 12/1999 | Choy | 30/226 |
| 6,192,590 B1 | * | 2/2001 | Yeh | 30/226 |
| 6,434,833 B1 | * | 8/2002 | Yeh | 30/226 |

FOREIGN PATENT DOCUMENTS

| | | | |
|---|---|---|---|
| GB | 1537614 | 1/1979 | |
| GB | 2315037 | 1/1998 | |
| GB | 2337721 A | * 12/1999 | B26B/13/12 |

OTHER PUBLICATIONS

Houser et al., Cable Slitter, IBM technical disclosure bulletin, vol. 13 No. 10, Mar. 1971.

* cited by examiner

*Primary Examiner*—Allan N. Shoap
*Assistant Examiner*—John Windmuller
(74) *Attorney, Agent, or Firm*—Alan D. Kamrath; Rider Bennett, LLP

(57) ABSTRACT

A pair of hairdressing scissors comprises two cutting members pivotally connected together. Each cutting member comprises a handle at a first end thereof and a blade at a second end thereof. A receiving groove is defined in a side of at least one of the handles, and an L-shaped slot is defined in the other side of said at least one of the handles. A connecting block is partially, securely mounted in the receiving groove with an L-shaped portion exposed outside the receiving groove. The L-shaped portion of the connecting block of a pair of hairdressing scissors is releasably engaged with the L-shaped slot of another pair of hairdressing scissors, thereby allowing assembly of plural pairs of hairdressing scissors for proceeding with special haircutting.

6 Claims, 13 Drawing Sheets

HAIRDRESSING SCISSORS HAVING A DETACHABLE CONNECTING BLOCK

BACKGROUND OF THE INVENTION

1. Field of the Invention

The present invention relates to a pair of hairdressing scissors having a detachable connecting block to allow assembly of plural pairs of hairdressing scissors for proceeding with special haircutting.

2. Description of the Related Art

A hairstylist cuts a customer's hair with several techniques, including trimming, thinning, layering, etc. Sometimes the hairstylist has to hold plural pairs of scissors in the same hand for proceeding with the thinning or layering of the hair to obtain the desired special hairstyle.

During operation of the plural pairs of scissors in the same hand, the user must keep the plural pairs of scissors be spaced at regular intervals and operate them with the same operating condition. The plural pairs of scissors must open and close synchronously to obtain a tidy, beautiful hairstyle. However, the plural pairs of scissors are simply held by the index finger and the thumb of the user such that the plural pairs of scissors cannot be operated synchronously due to touchy control of the plural pairs of scissors by the fingers. Thus, the plural pairs of scissors often become skew to one another and the spacing therebetween may be different from one another. The haircutting result is adversely affected, and this problem is aggravated if the user is inexperienced. The user often feels pain when operating the plural pairs of scissors in addition to numerous limitations to and difficulties in operation.

U.S. Pat. No. 6,192,590 to Applicant issued on Feb. 27, 2001 and Applicant's U.S. patent application Ser. No. 09/617,713 disclose hairdressing scissor assemblies to solve the above-mentioned problems. The present invention is intended to provide a different design in this regard.

SUMMARY OF THE INVENTION

An object of the present invention is to provide a pair of hairdressing scissors having a detachable connecting block to allow assembly of plural pairs of the hairdressing scissors for proceeding with special haircutting.

A pair of hairdressing scissors in accordance with the present invention comprises two cutting members pivotally connected together. Each cutting member comprises a handle at a first end thereof and a blade at a second end thereof. A receiving groove is defined in a side of at least one of the handles, and an L-shaped slot is defined in the other side of said at least one of the handles. A connecting block is partially, securely mounted in the receiving groove with an L-shaped portion exposed outside the receiving groove. The L-shaped portion of the connecting block of a pair of hairdressing scissors is releasably engaged with the L-shaped slot of another pair of hairdressing scissors, thereby allowing assembly of plural pairs of hairdressing scissors for proceeding with special haircutting.

In an alternative embodiment of the invention, the handle of each cutting member has an upper screw hole and a lower screw hole. Each connecting block is L-shaped and has a threaded member for threadedly engaging with one of the upper screw hole and the lower screw hole.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
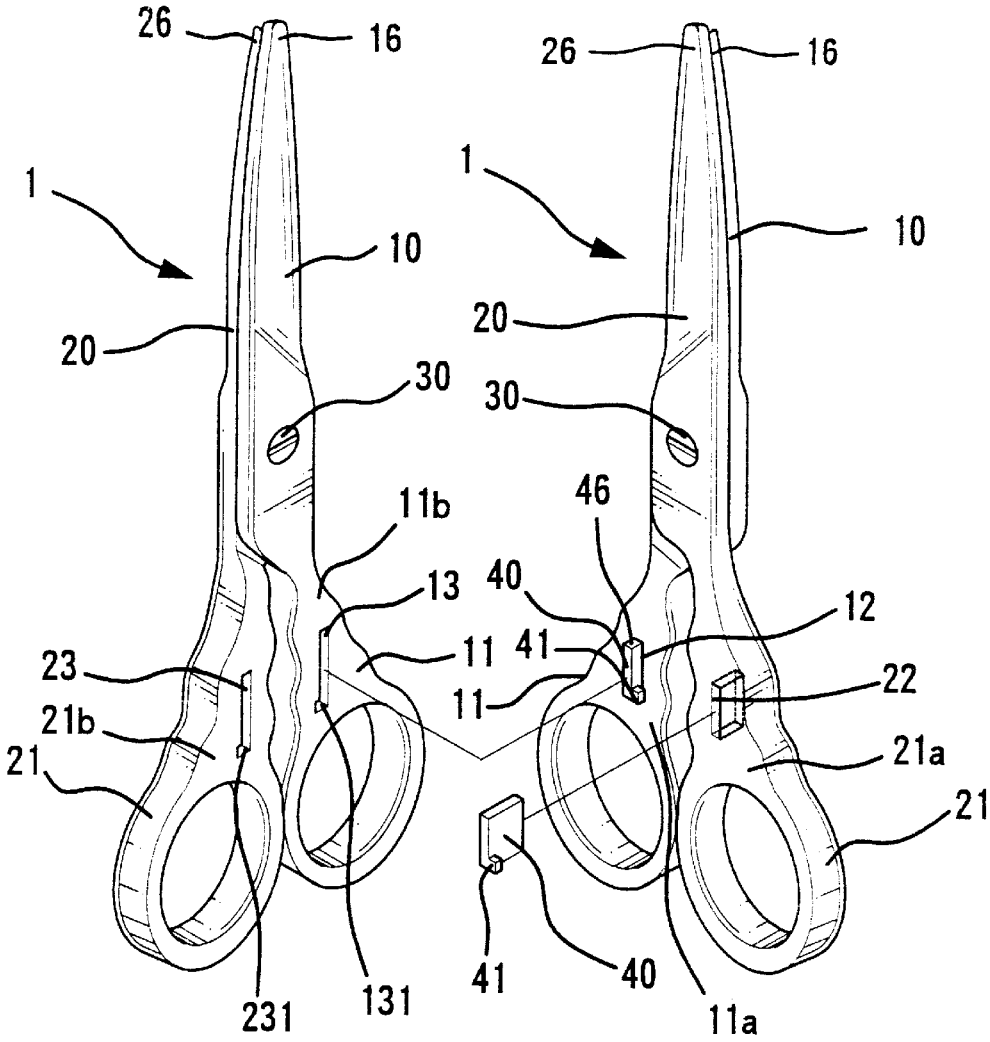
FIG. 1 is an exploded perspective view of a hairdressing scissor assembly comprising two pairs of hairdressing scissors in accordance with the present invention.

Referring to FIG. 1, a first embodiment of a hairdressing scissor assembly in accordance with the present invention generally comprises plural pairs of scissors 1 each having first and second cutting members that are pivoted together by a pivot 30. The first cutting member comprises a first handle 11 on an end thereof and a first blade 10 on the other end thereof. The second cutting member comprises a second handle 21 on an end thereof and a second blade 20 on the other end thereof. Each blade 10, 20 has a tip 16, 26. The first and second cutting members are pivoted together at intermediate portions thereof. Of course, each handle 11, 21 has an opening (not labeled) for the thumb or index finger of the user.

At least one of the first handle 11 and the second handle 21 has a receiving groove 12, 22 defined in a first side 11*a*, 21*a* thereof and an L-shaped slot 13, 23 defined in a second side thereof 11*b*, 21*b* opposite to the first side 11*a*, 21*a*. A connecting block 40 is securely mounted in the receiving groove 12, 22 to allow engagement of two pairs of scissors 1. In this embodiment, each of the first handle 11 and the second handle 21 has a receiving groove 12, 22 defined therein for engaging with a respective connecting block 40.

Figure 2:
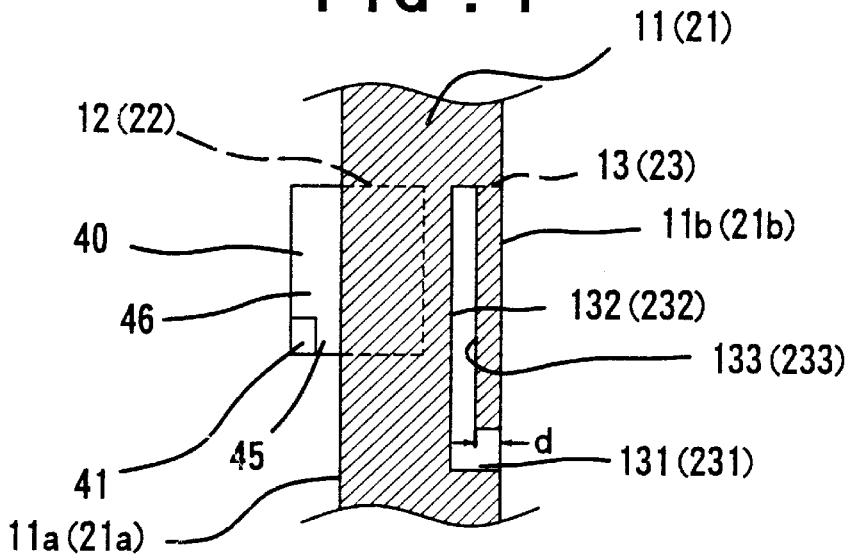
FIG. 2 is a partial sectional view illustrating position of a connecting block of a pair of hairdressing scissors in accordance with the present invention.

Referring to FIG. 2, each connecting block 40 has an L-shaped portion 46 exposed outside the receiving groove 12, 22. The L-shaped portion 46 comprises an end lug 41, and a gap 45 is defined between the end lug 41 and the respective first side 11*a*, 21*a* of the respective handle 11, 21 of the pair of hairdressing scissor. As illustrated in FIG. 2, each handle 11, 21 further comprises a guiding channel 132, 232 defined therein and communicated with a respective L-shaped slot 131, 231 that is defined in the second side 11*b*, 21*b* of the respective handle 11, 21.

Figure 4:
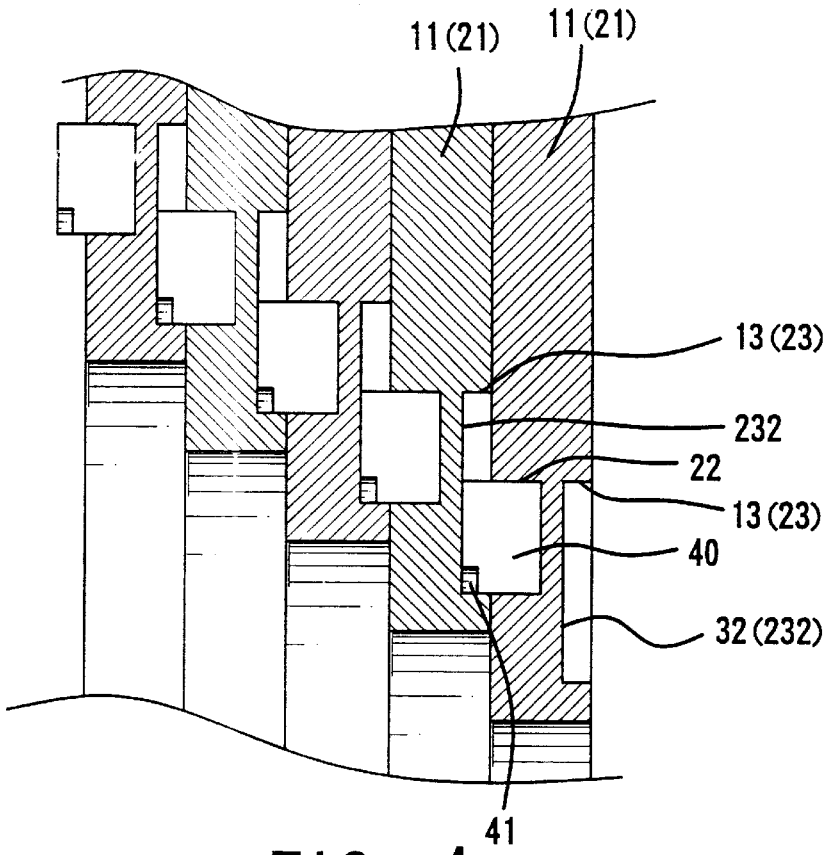
FIG. 4 is a partial sectional view, taken along plane 8—8 in FIG. 7, illustrating a hairdressing scissor assembly comprising five pairs of hairdressing scissors each having a connecting block in FIG. 2, wherein the hairdressing scissor assembly is not in an engaged position, and the tips of the plural pairs of hairdressing scissors are aligned along an inclined line and located at different levels.
Figure 5:
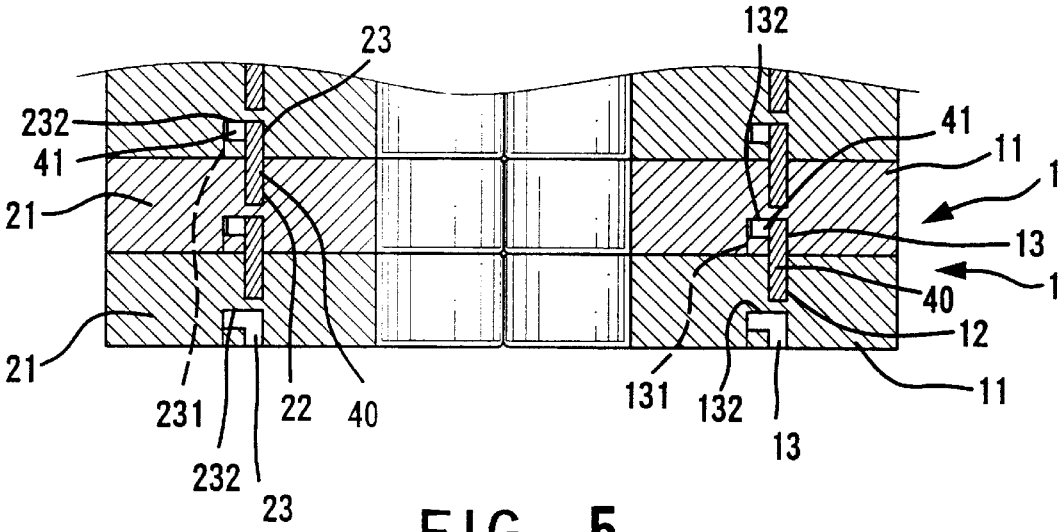
FIG. 5 is a partial sectional view, taken along plane 9—9 in FIG. 7, of the hairdressing scissor assembly in FIG. 4.

When engaging one pair of scissors 1 with another pair of scissors 1, each. connecting block 40 of one pair of scissors 1 is inserted via the respective L-shaped slot 13, 23 into the guiding channel 132, 232 of the respective handle 11, 21 of another pair of scissors 1, as shown in FIGS. 4 and 5. It is noted that the hairdressing scissor assembly is not in an engaged position, and the tips 16 and 26 of the plural pairs of hairdressing scissors are aligned along an inclined line and located at different levels.

Figure 6:
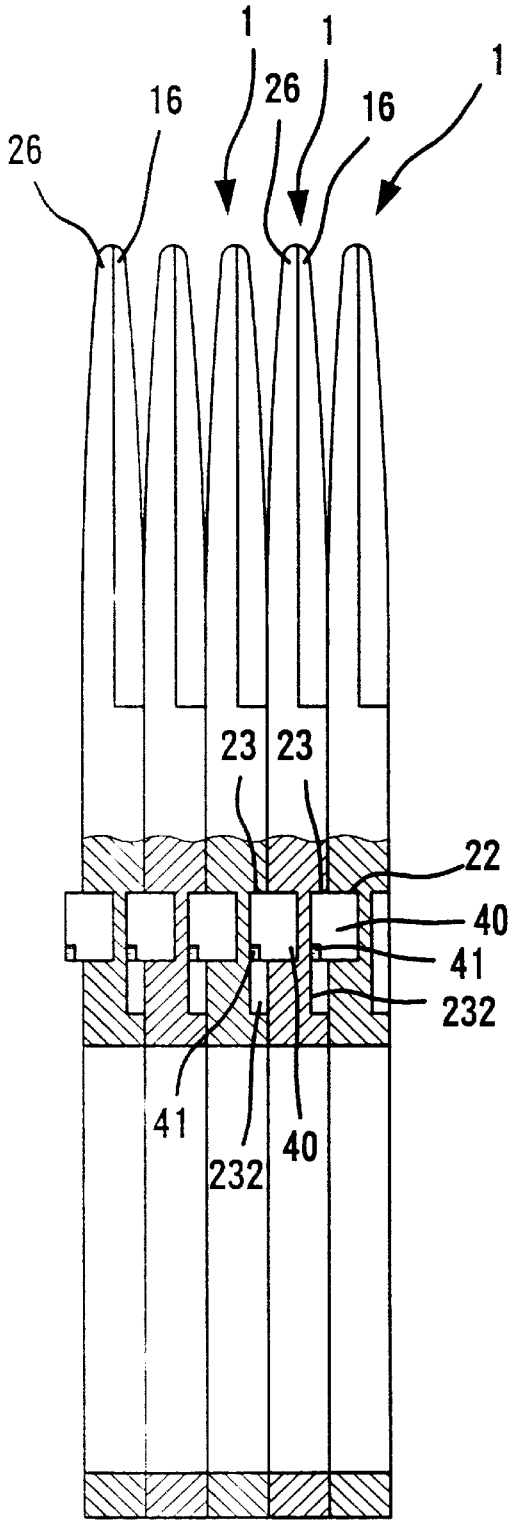
FIG. 6 is a side view, partly sectioned, of the hairdressing scissor assembly in FIG. 4, wherein the hairdressing scissor assembly is in an engaged position, and the tips of the plural pairs of hairdressing scissors are aligned along a straight line and located at the same level.

Then, the right one of two adjacent pairs of scissors 1 may be moved upward relative to the left one of the two adjacent pairs of scissors 1 until the end lug 41 of each connecting block 40 of the right one of the two adjacent pairs of scissors 1 is disengaged from a relatively shorter section 131, 231 of the respective L-shaped slot 13, 23 of the left one of the two adjacent pairs of scissors 1, thereby forming a hairdressing scissor assembly shown in FIG. 6, in which the tips 16 and 26 of the hairdressing scissors 1 are aligned along a straight line and located at the same level. The gap 45 of each connecting block 40 receives a wall thickness d (FIG. 2) between the second side 11*b*, 21*b* of the respective handle 11, 21 and a wall face 133, 233 that defines the respective guide channel 132, 232 and that is adjacent to the respective second side 11*b*, 21*b*.

Figure 3:
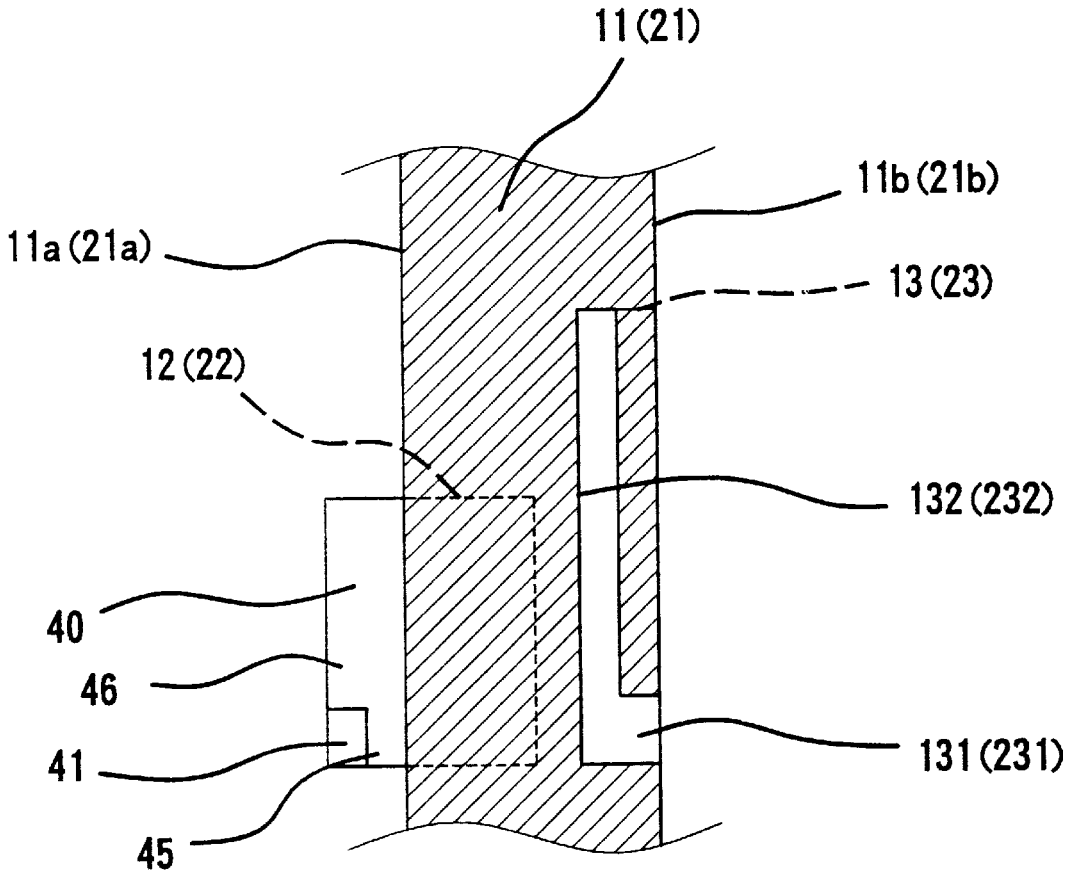
FIG. 3 is a view similar to FIG. 2, illustrating a modified embodiment of the connecting block.
Figure 7:
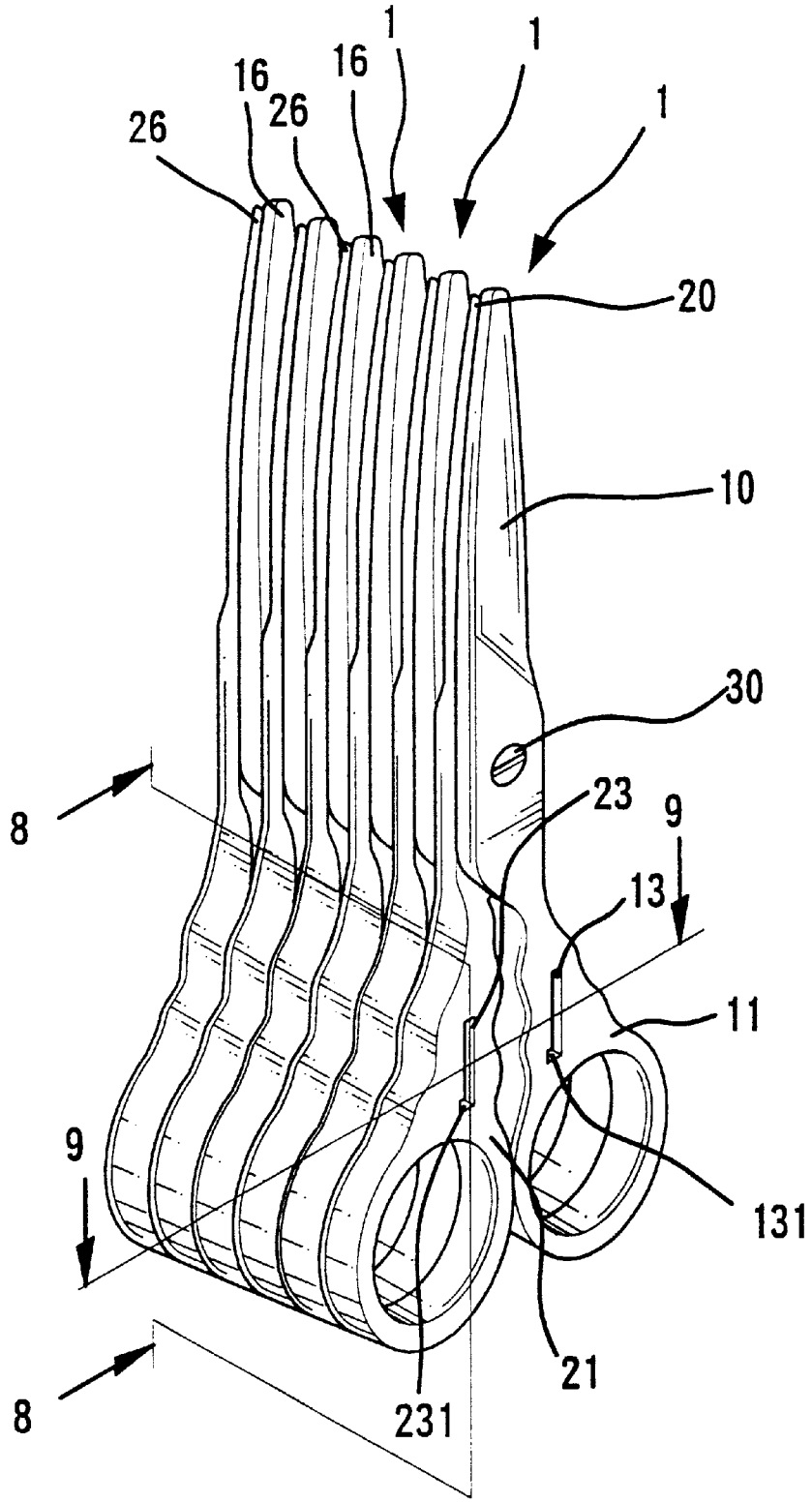
FIG. 7 is a perspective view of a hairdressing scissor assembly comprising five pairs of hairdressing scissors each having a connecting block in FIG. 3, wherein the hairdressing scissor assembly is not in an engaged position, and the tips of the plural pairs of hairdressing scissors are aligned along a straight line and located at the same level.
Figure 8:
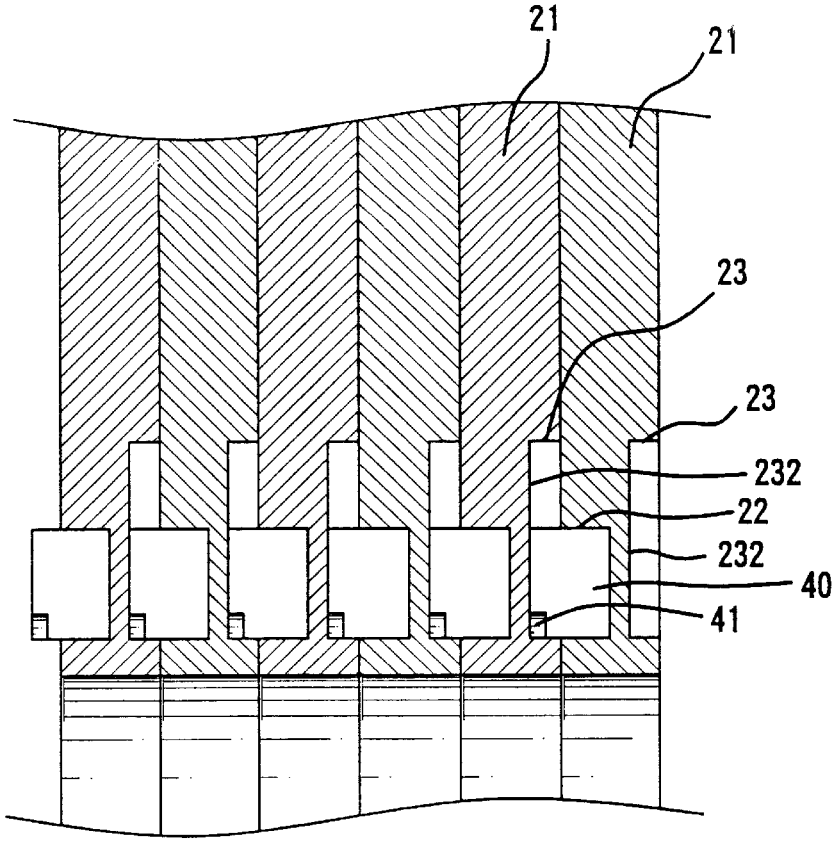
FIG. 8 is a partial sectional view taken along plane 8—8 in FIG. 7.
Figure 9:
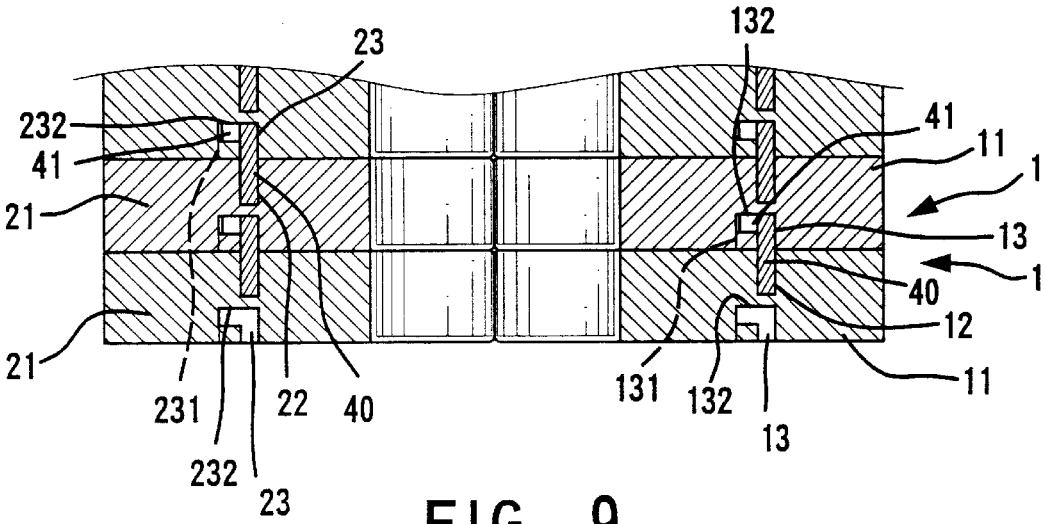
FIG. 9 is a partial sectional view taken along plane 9—9 in FIG. 7.
Figure 10:
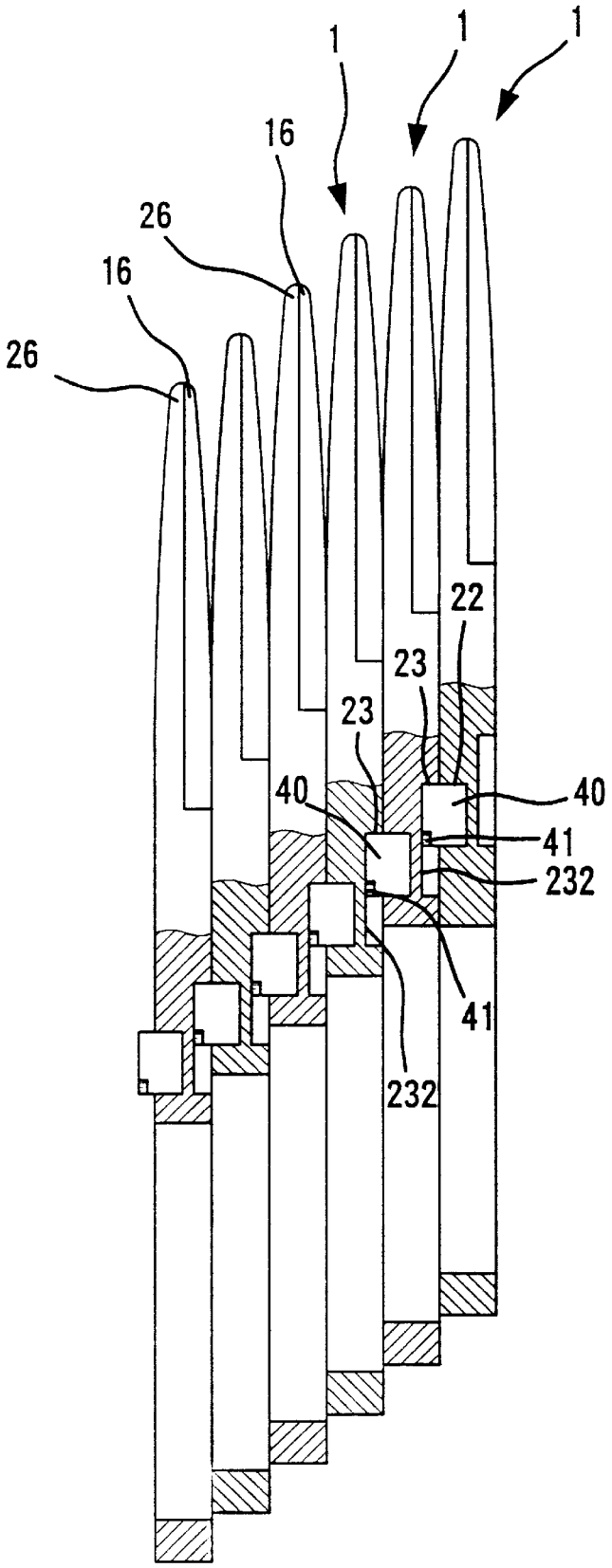
FIG. 10 is a side view, partly sectioned, of the hairdressing scissor assembly in FIG. 7, wherein the hairdressing scissor assembly is in an engaged position, and the tips of the plural pairs of hairdressing scissors are aligned along an inclined line and located at different levels.

FIG. 3 illustrates a modified embodiment of the connecting block 40, wherein the position of the end lug 41 is at a level the same as the relatively shorter section 131, 231 of the respective cutting element 10, 20, while the position of the end lug 41 in the embodiment shown in FIG. 2 is at a level higher than the relatively shorter section 131, 231 of the respective handle 11, 21. As a result, when a hairdressing scissor assembly (FIG. 7) comprising plural pairs of hairdressing scissors having the connecting blocks 40 shown in FIG. 3 is not in an engaged position (FIGS. 8 and 9), the tips 16 and 26 of the plural pairs of hairdressing scissors are aligned along a straight line and located at the same level. Referring to FIG. 10, when the hairdressing scissor assembly is moved an engaged position via an operation identical to that for the above embodiment, the tips 16 and 26 of the plural pairs of hairdressing scissors are aligned along an inclined line and located at different levels.

Figure 11:
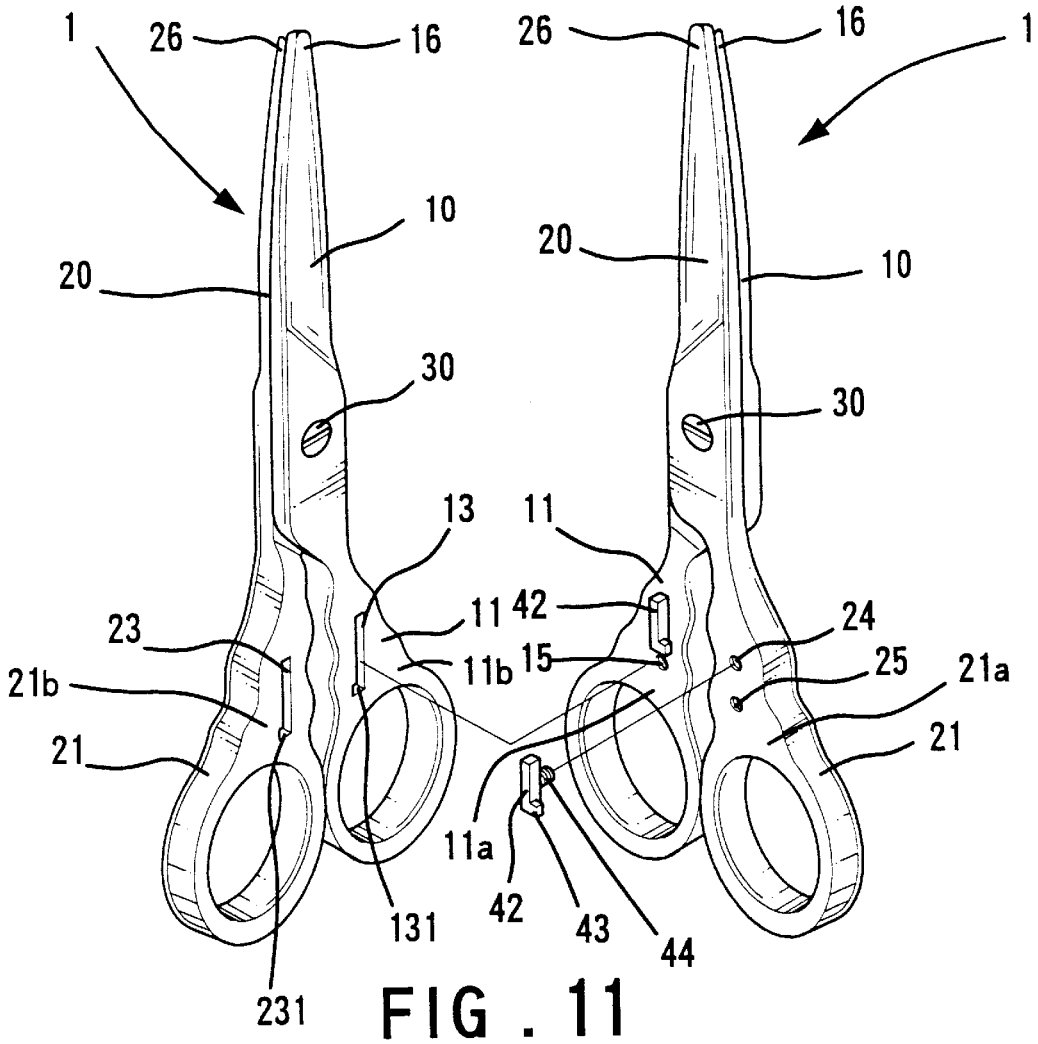
FIG. 11 is an exploded perspective view of a second embodiment of a hairdressing scissor assembly comprising two pairs of hairdressing scissors in accordance with the present invention.

FIG. 11 illustrates a second embodiment of the hairdressing scissor assembly which differs from the first embodiment in the connecting block. In this embodiment, each connecting block (now designated by 42) is L-shaped and comprises an end lug 43 and a threaded member 44 extending from a side of a relatively longer section of the connecting block 42. In addition, each handle 11, 21 of the pair of hairdressing scissors has an upper screw hole 24 and a lower screw hole 25. In an arrangement of the second embodiment, the threaded member 44 of each connecting block 42 is engaged with the upper screw hole 24 of each handle 11, 21, as shown in FIG. 2. In an alternate arrangement of the second embodiment, the threaded member 44 of each connecting block 42 of engaged with the lower screw hole 25 of each handle 11, 21, as shown in FIG. 3. Similar to the above embodiments, a gap 45 is defined between the end lug 43 of each connecting block 42 and the first side 11*a*, 21*a* of the respective handle 11, 21.

Figure 12:
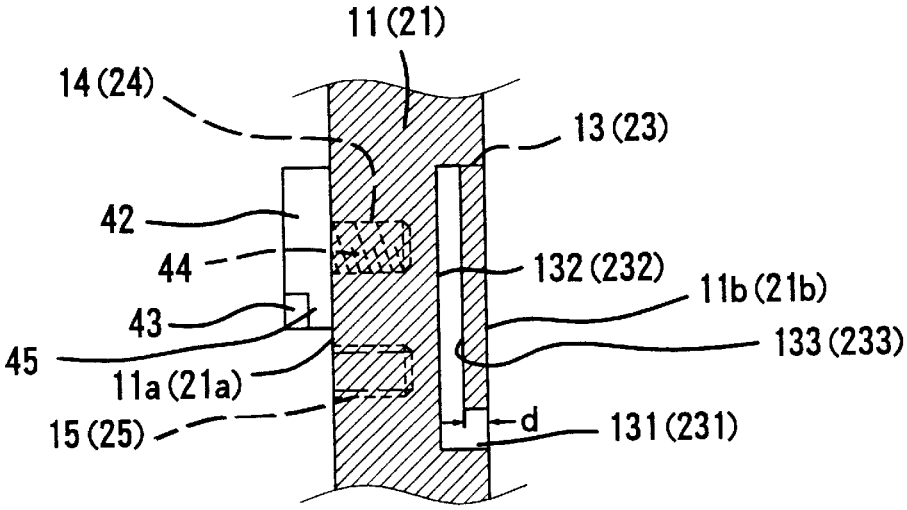
FIG. 12 is a partial sectional view illustrating position of a connecting block of a pair of the hairdressing scissors in FIG. 11.
Figure 14:
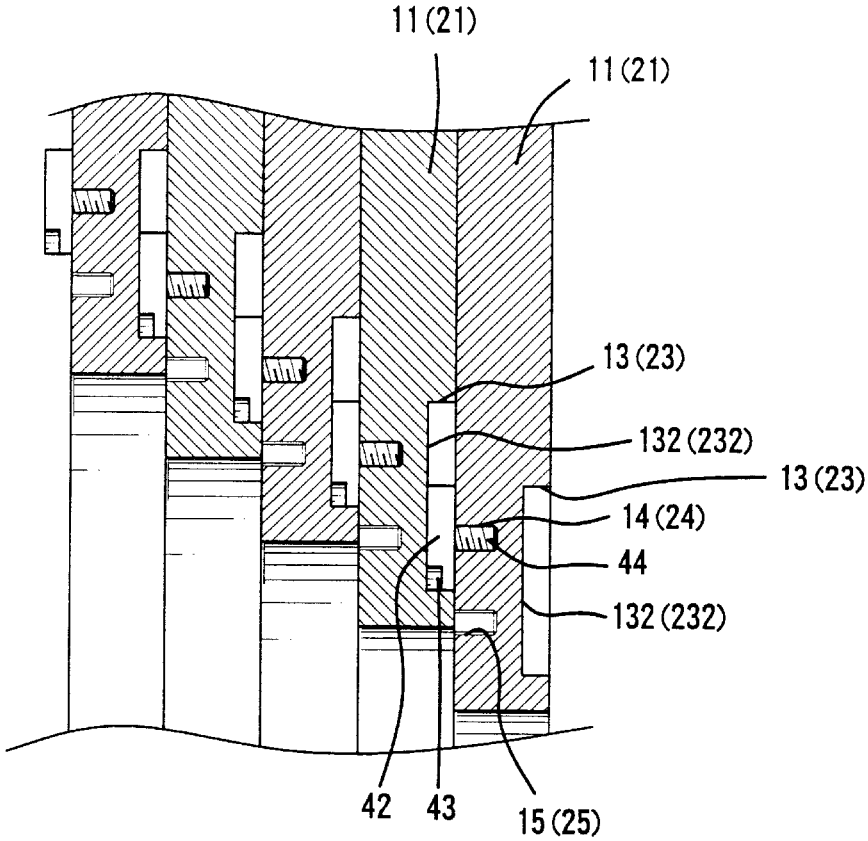
FIG. 14 is a sectional view illustrating a hairdressing scissor assembly comprising five pairs of hairdressing scissors each having a connecting block in FIG. 12, wherein the hairdressing scissor assembly is not in an engaged position, and the tips of the plural pairs of hairdressing scissors are aligned along an inclined line and located at different levels.
Figure 15:
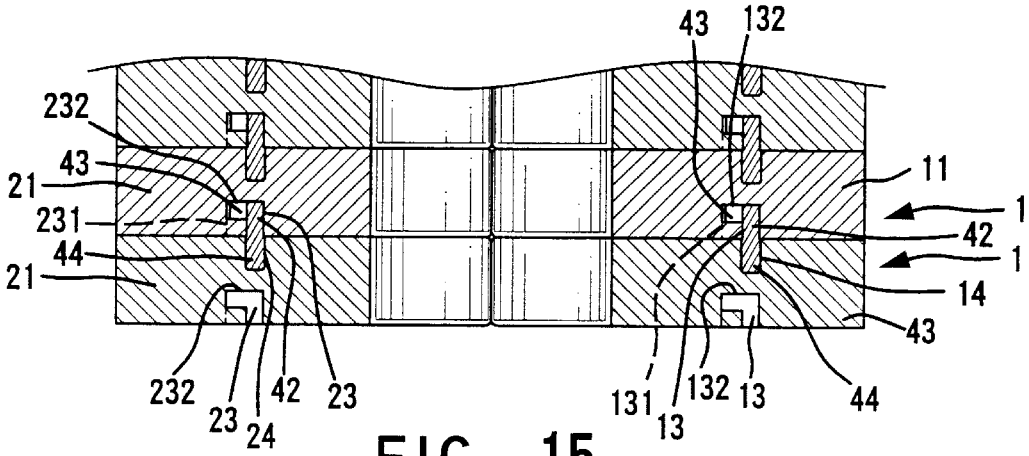
FIG. 15 is another partial sectional view of the hairdressing scissor assembly in FIG. 14.

When engaging one pair of scissors 1 with another pair of scissors 1 having the connecting blocks 42 shown in FIG. 12, each connecting block 42 of one pair of scissors 1 is inserted into the guiding channel 132, 232 of the respective handle 11, 21 of another pair of scissors 1, as shown in FIGS. 14 and 15. It is noted that the hairdressing scissor assembly is not in an engaged position, and the tips 16 and 26 of the plural pairs of hairdressing scissors are aligned along an inclined line and located at different levels.

Figure 16:
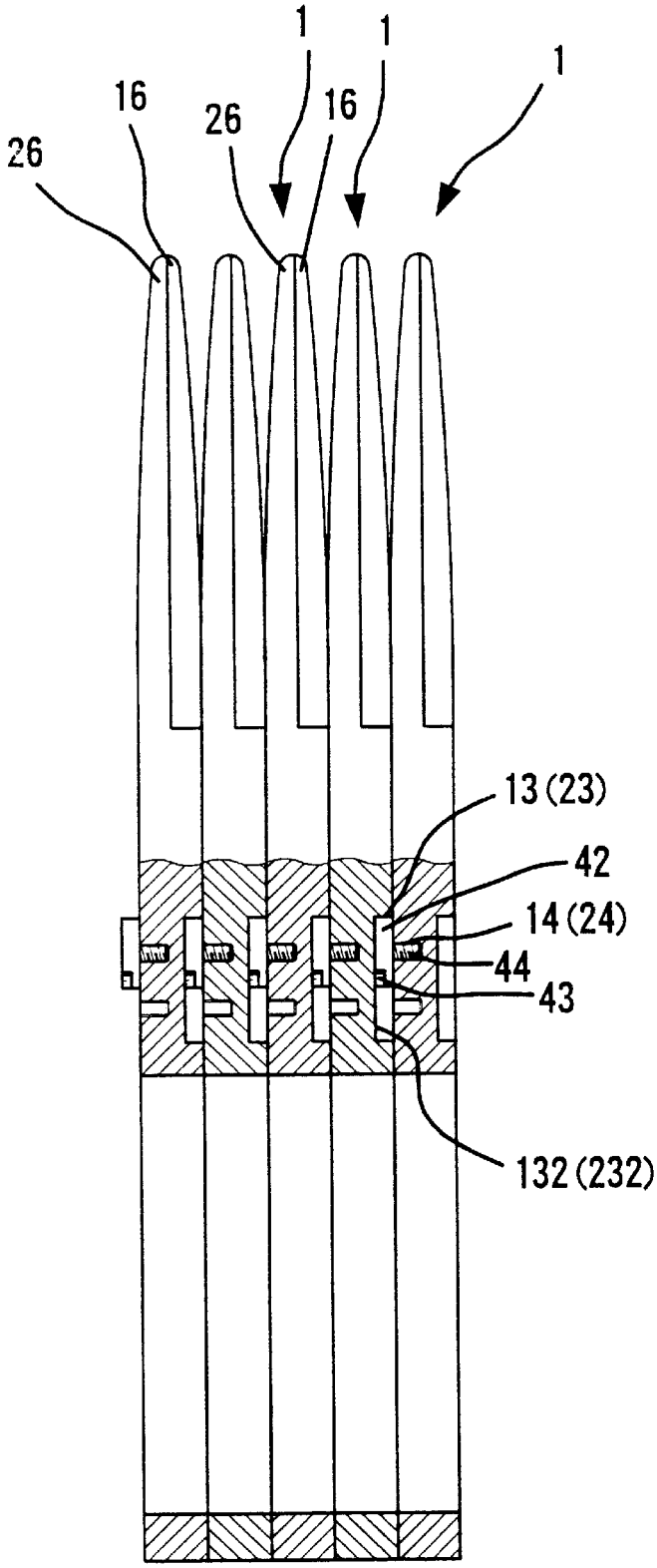
FIG. 16 is a side view, partly sectioned, of the hairdressing scissor assembly in FIG. 14, wherein the hairdressing scissor assembly is in an engaged position, and the tips of the plural pairs of hairdressing scissors are aligned along a straight line and located at the same level.

Then, the right one of two adjacent pairs of scissors 1 may be moved upward relative to the left one of the two adjacent pairs of scissors 1 until the end lug 41 of each connecting block 40 of the right one of the two adjacent pairs of scissors 1 is disengaged from a relatively shorter section 131, 231 of the respective L-shaped slot 13, 23 of the left one of the two adjacent pairs of scissors 1, thereby forming a hairdressing scissor assembly shown in FIG. 16, in which the tips 16 and 26 of the hairdressing scissors 1 are aligned along a straight line and located at the same level. The gap 45 of each connecting block 40 receives a wall thickness d (FIG. 12) between the second side 11*b*, 21*b* of the respective handle 11, 21 and a wall face 133, 233 that defines the respective guide channel 132, 232 and that is adjacent to the respective second side 11*b*, 21*b*.

Figure 13:
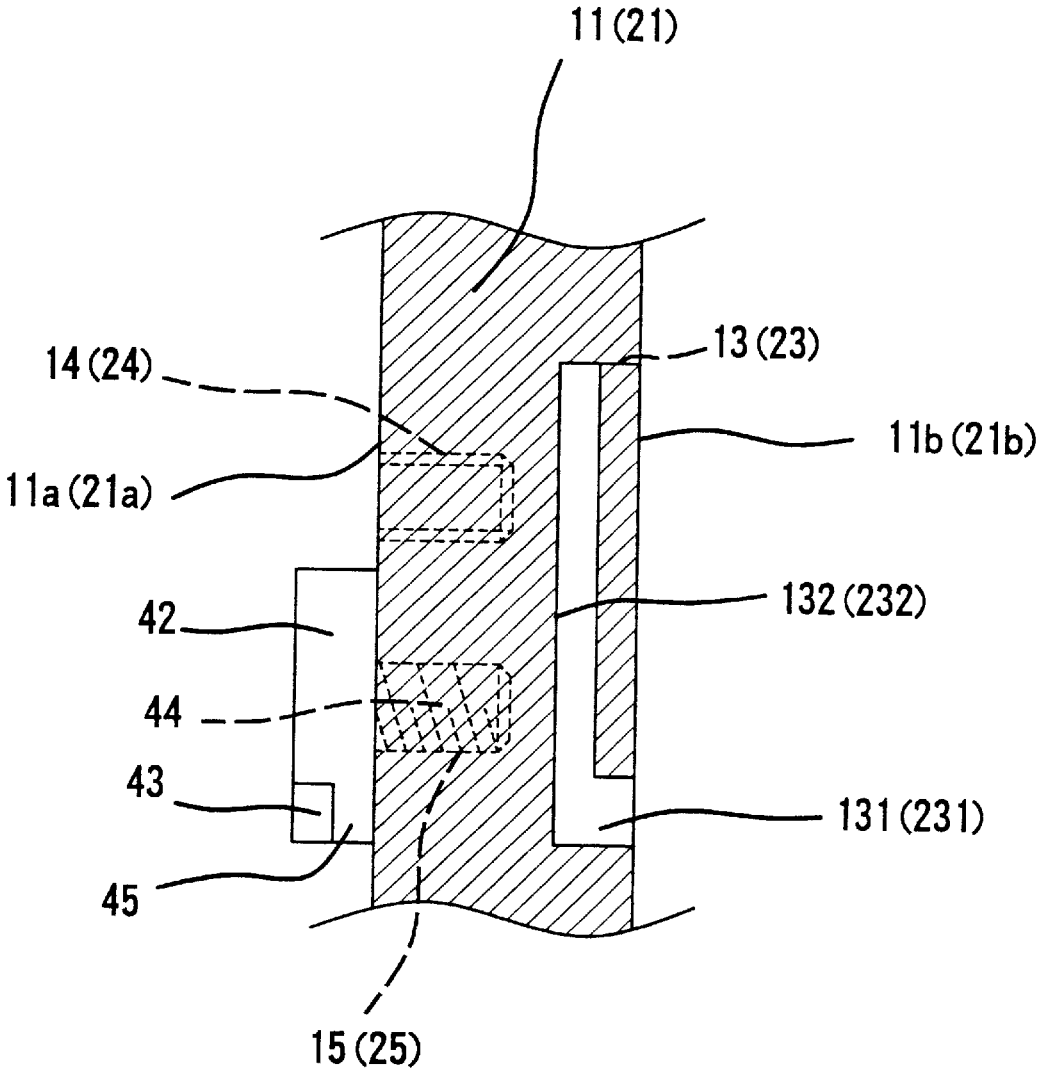
FIG. 13 is a view similar to FIG. 12, wherein the connecting block is engaged with a lower hole of a cutting element.
Figure 17:
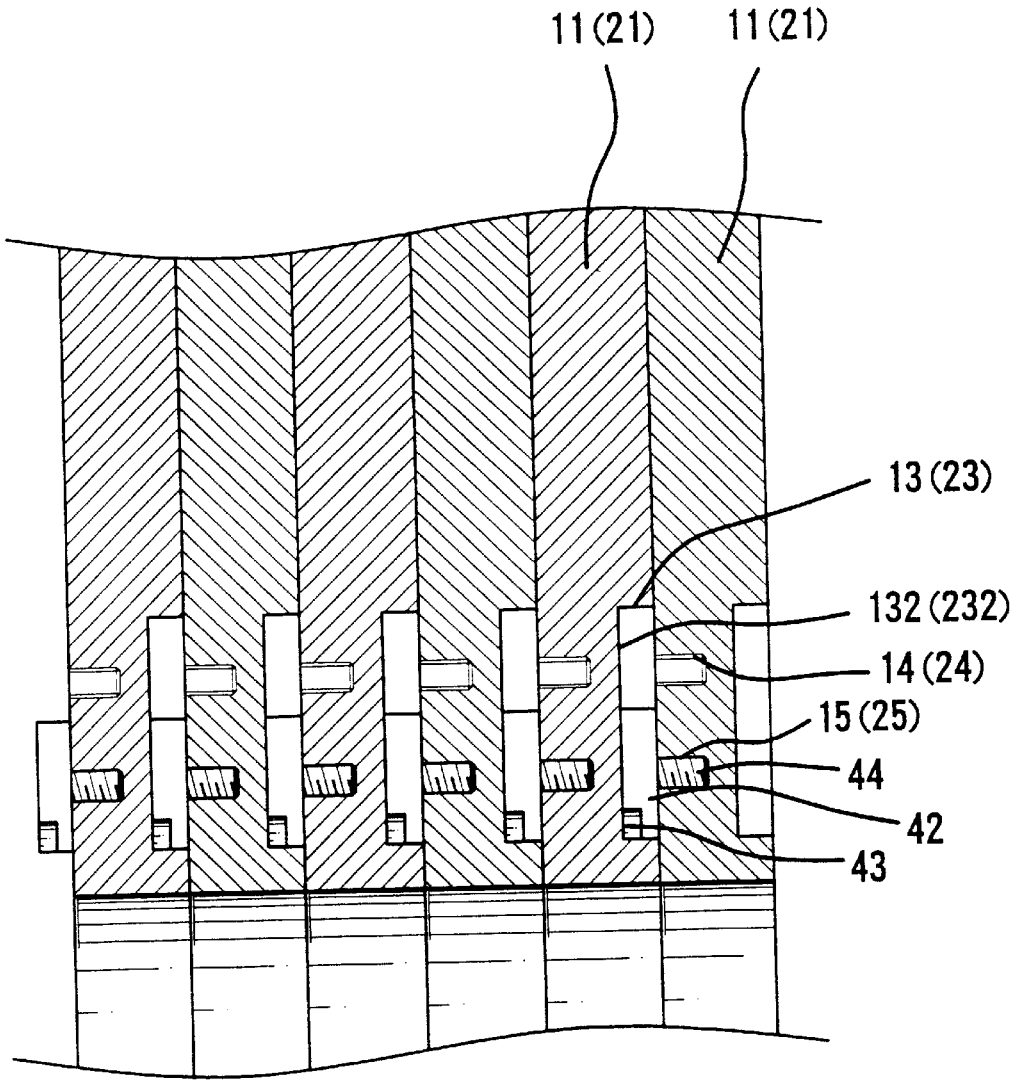
FIG. 17 is a partial sectional view of a hairdressing scissor assembly comprising five pairs of hairdressing scissors each having a connecting block in FIG. 13, wherein the hairdressing scissor assembly is not in an engaged position, and the tips of the plural pairs of hairdressing scissors are aligned along a straight line and located at the same level.
Figure 18:
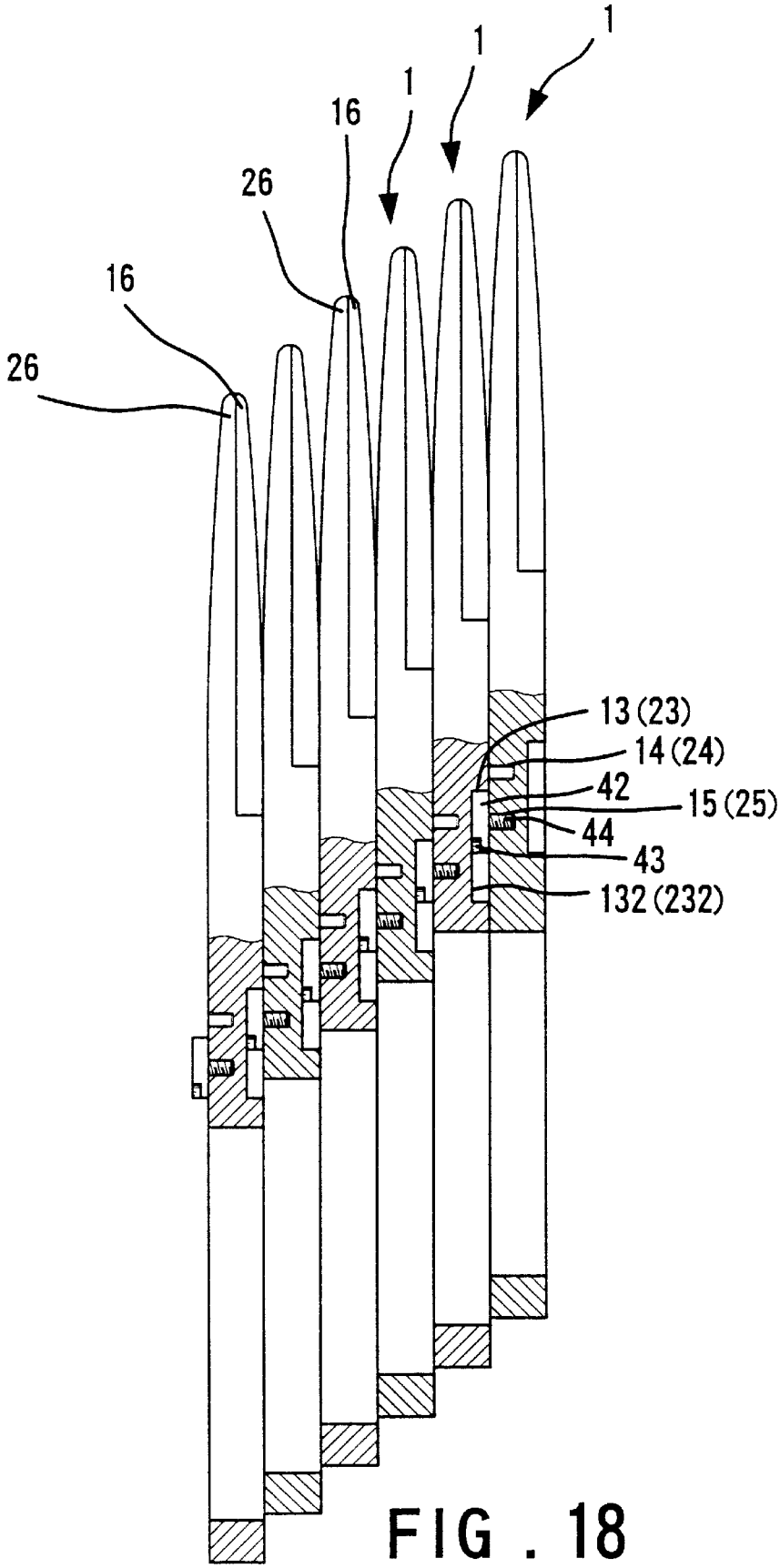
FIG. 18 is a side view, partly sectioned, of the hairdressing scissor assembly in FIG. 17, wherein the hairdressing scissor assembly is in an engaged position, and the tips of the plural pairs of hairdressing scissors are aligned along an inclined line and located at different levels.

When a hairdressing scissor assembly comprising plural pairs of hairdressing scissors having the connecting blocks 42 shown in FIG. 13 is not in an engaged position (FIG. 17), the tips 16 and 26 of the plural pairs of hairdressing scissors are aligned along a straight line and located at the same level. Referring to FIG. 18, when the hairdressing scissor assembly is moved to an engaged position via an operation identical to that for the second embodiment, the tips 16 and 26 of the plural pairs of hairdressing scissors are aligned along an inclined line and located at different levels.

According to the above description, it is appreciated that the hairdressing scissors 1 in accordance with the present invention can be releasably engaged with one another to form a hairdressing scissor assembly with the tips of the scissors located at the same level or different levels to proceed with different haircutting functions.

Although the invention has been explained in relation to its preferred embodiment, it is to be understood that many other possible modifications and variations can be made without departing from the scope of the invention as hereinafter claimed.

What is claimed is:

1. A pair of hairdressing scissors comprising:

a first cutting member and a second cutting member pivotally connected together, the first cutting member comprising a first handle at a first end thereof and a first blade at a second end thereof, the second cutting member comprising a second handle at a first end thereof and a second blade at a second end thereof, each of the first handle and the second handle having a first side and a second side opposite to the first side, a receiving groove being defined in the first side of at least one of the first handle and the second handle, an L-shaped slot being defined in the second side of said at least one of the first handle and the second handle, said at least one of the first handle and the second handle further comprising a guide channel defined therein and communicated with the L-shaped slot; and a connecting block partially, securely mounted in the receiving groove, the connecting block, comprising an L-shaped portion outside the receiving groove, said portion comprising a main part and an end lug, a gap being defined between the end lug and the second side of said at least one of the first handle and the second handle;

the connecting block of one pair of hairdressing scissors being insertable into the L-shaped slot of another pair of hairdressing scissors with the end lug of the connecting block of said one pair of hairdressing scissors inserting to the guide channel of said another pair of hairdressing scissors via a relatively shorter section of the L-shaped slot of said another pair of hairdressing scissors, the connecting block of said one pair of hairdressing scissors being then movable to an engaged position in which the end lug of said one pair of hairdressing scissors is moved from the relatively shorter section of the L-shaped slot of said another pair of hairdressing scissors into the guide channel of said another pair of hairdressing scissors to thereby secure said one pair of hairdressing scissors and said another pair of hairdressing scissors together.

2. The pair of hairdressing scissors as claimed in claim 1, wherein the each of the first blade and the second blade has a tip, and wherein the tips of said one pair of hairdressing scissors and said another pair of hairdressing scissors that are engaged with each other are aligned along an inclined line and located at different levels.

3. The pair of hairdressing scissors as claimed in claim 1, wherein each of the first blade and the second blade has a tip, and wherein the tips of said one pair of hairdressing scissors and said another pair of hairdressing scissors that are engaged with each other are aligned along a straight line and located at the same level.

4. A pair of hairdressing scissors comprising:

a first cutting member and a second cutting member pivotally connected together, the first cutting member comprising a first handle at a first end thereof and a first blade at a second end thereof, the second cutting member comprising a second handle at a first end thereof and a second blade at a second end thereof, each of the first handle and the second handle having a first side and a second side opposite to the first side, an upper screw hole and a lower screw hole being defined in the first side of at least one of the first handle and the second handle, an L-shaped slot being defined in the second side of said at least one of the first handle and the second handle, said at least one of the first handle and the second handle further comprising a guide channel defined therein and communicated with the L-shaped slot; and a connecting block comprising a threaded member for threadedly engaged in one of the upper screw hole and the lower screw hole, the connecting block being L-shaped, said L-shape comprising a main part and an end lug, a gap being defined between the end lug and the second side of said at least one of the first handle and the second handle;

the connecting block of one pair of hairdressing scissors being insertable into the L-shaped slot of another pair of hairdressing scissors with the end lug of the connecting block of said one pair of hairdressing scissors inserting to the guide channel of said another pair of hairdressing scissors via a relatively shorter section of the L-shaped slot of said another pair of hairdressing scissors, the connecting block of said one pair of hairdressing scissors being then movable to an engaged position in which the end lug of said one pair of hairdressing scissors is moved from the relatively shorter section of the L-shaped slot of said another pair of hairdressing scissors into the guide channel of said another pair of hairdressing scissors to thereby secure said one pair of hairdressing scissors and said another pair of hairdressing scissors together.

5. The pair of hairdressing scissors as claimed in claim 4, wherein the each of the first blade and the second blade has a tip, wherein the threaded member of the connecting block is engaged with the lower screw hole, and wherein the tips of said one pair of hairdressing scissors and said another pair of hairdressing scissors that are engaged with each other are aligned along an inclined line and located at different levels.

6. The pair of hairdressing scissors as claimed in claim 4, wherein each of the first blade and the second blade has a tip, wherein the threaded member of the connecting block is engaged with the upper screw hole, and wherein the tips of said one pair of hairdressing scissors and said another pair of hairdressing scissors that are engaged with each other are aligned along a straight line and located at the same level.

* * * * *